US005819319A

United States Patent [19]

Spurs

[11] Patent Number: 5,819,319

[45] Date of Patent: Oct. 13, 1998

[54] HAT WITH DETACHABLE HAIR

[76] Inventor: Robin Spurs, 138 Esperanza Ave., Sierra Madre, Calif. 91024

[21] Appl. No.: 714,573

[22] Filed: Sep. 16, 1996

[51] Int. Cl.[6] ..... A42B 1/06

[52] U.S. Cl. ..... 2/209.13; 2/172; 2/181.4

[58] Field of Search ..... 2/172, 181.4, 209.13, 2/918

[56] References Cited

U.S. PATENT DOCUMENTS 5,493,735 2/1996 Rice ..... 2/209.13
5,615,415 4/1997 Beckerman ..... 2/195.3

*Primary Examiner*—Diana Biefeld
*Attorney, Agent, or Firm*—Robert M. Sperry

[57] ABSTRACT

An improved hat having a plurality of releasably attachable hair segments, which can be attached, replaced or removed to provide a wide variety of effects.

10 Claims, 3 Drawing Sheets

HAT WITH DETACHABLE HAIR

FIELD OF INVENTION

This invention relates to headwear and is particularly directed to headwear having detachable hair.

PRIOR ART

Many people suffer from hair loss or baldness caused by disease, genetic factors, chemotherapy or other factors. However, such hair loss or baldness is generally considered to be unsightly and often subjects the victim to ridicule, mocking and social banishment. Wigs can sometimes be used to hide baldness. However, wigs can be uncomfortable and often irritate the scalp and, thus, aggravate the condition. Accordingly, it is often desirable to be able to wear a hat, having artificial hair attached thereto, which projects below the hat, as would be the case if the wearer actually had hair. Numerous prior art hats with attached hair have been proposed heretofore. However, in most cases, the hair has been fixedly attached and is stiff and uncomfortable. Consequently, the appearance of the hat and hair is always the same, whereas with persons having their own hair, the hair length changes from time to time as the hair grows and there may be times when no hair is seen. For example, when the wearer has an upsweep hairdo or has recently had a short hair cut. Also, a person may sometimes wear bangs, which will project below a hat, and sometimes may not wear bangs and, hence, will have no hair projecting from a hat. None of the prior art hats with attached hair have been able to accommodate these differences. Thus, none of the prior art hats with attached hair have been entirely satisfactory.

BRIEF SUMMARY AND OBJECTS OF INVENTION

These disadvantages of the prior art are overcome with the present invention and improved hat having attachable hair with comfortable elastic inserts is provided which can be altered to simulate a wide variety of appearances.

These advantages of the present invention are preferably attained by providing an improved hat having a plurality of releasably attachable hair segments, which can be attached, replaced or removed to provide a wide variety of effects.

Accordingly, it is an object of the present invention to provide an improved hat with attachable hair.

Another object of the present invention is to provide an improved head covering for person suffering from hair loss or baldness to enable such persons to simulate having hair.

An additional object of the present invention is to provide an improved hat having releasably attachable hair.

A further object of the present invention is to provide an improved hat having releasably attachable hair which can be altered to provide a wide variety of appearances.

A specific object of the present invention is to provide an improved hat having a plurality of releasably attachable hair segments, which can be attached, replaced or removed to provide a wide variety of effects.

These and other objects and features of the present invention will be apparent from the following detailed description, taken with reference to the figures of the accompanying drawings.

DETAILED DESCRIPTION OF THE INVENTION

Figure 1:
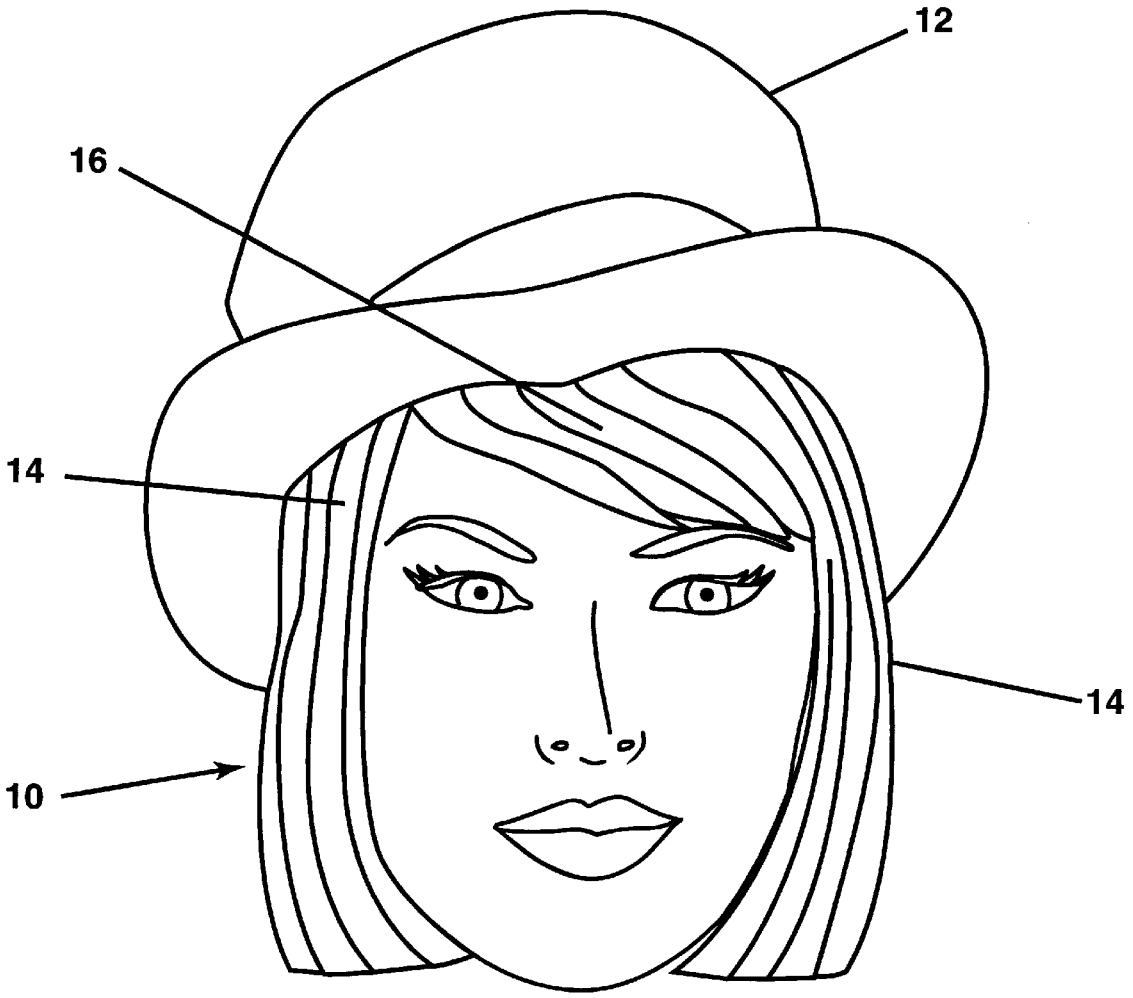
FIG. 1 is an isometric view of a person wearing a hat having attached hair in accordance with the present invention.
Figure 2:
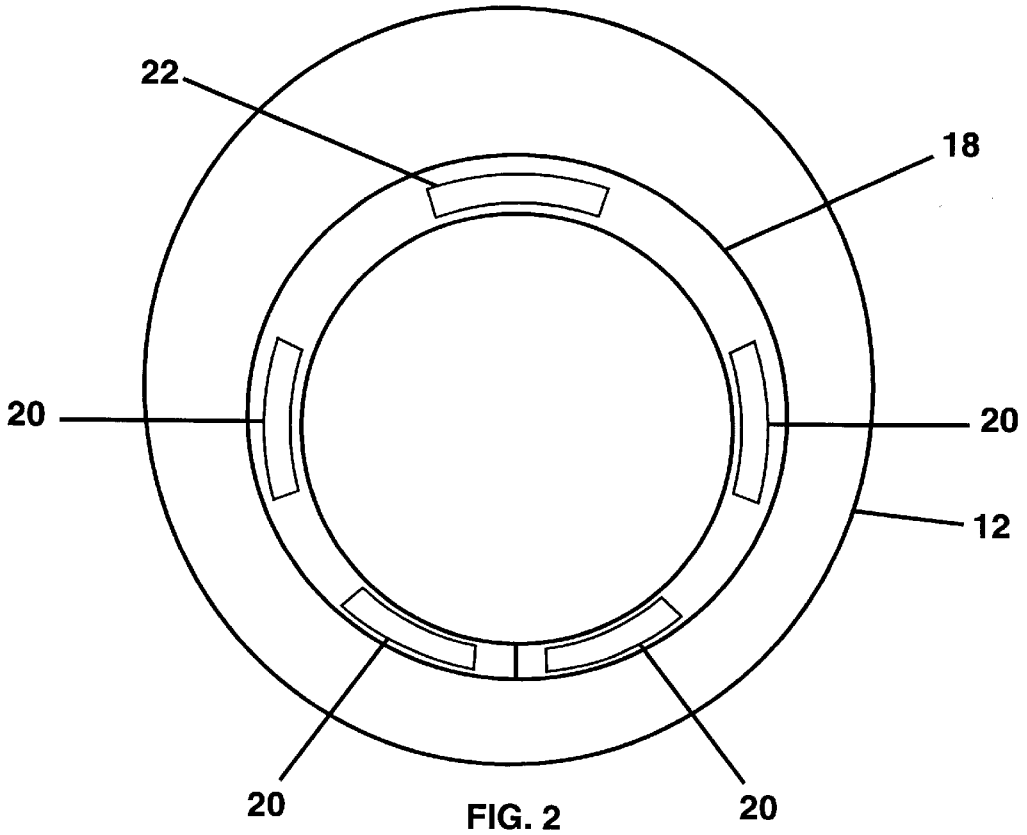
FIG. 2 is a bottom view of the hat of FIG. 1 with the hair segments remover for clarity.

In that form of the present invention chosen for purposes of illustration, FIG. 1 shows a person, indicated generally at 10, wearing a hat 12 having a hair segment 14, which extends from the temple rearward about the back of the head and forward to the opposite temple, and a bangs segment 16, which are releasably attached to the hat 12. As best seen in FIG. 2, the hat 12 has an elastic sweat band 18 encircling the interior of the hat 12 and carrying a plurality of patches 20 and 22 of the "loop" type of the releasably attaching material known as hook-and-loop material. Use of the "loop" type of hook-and-loop material on the sweat band 18 is important, since the "hook" type material is stiff and tends to be scratchy, which can snag any hair which the wearer has and could irritate the scalp and could possibly cause or aggravate scalp problems. Also, it should be understood that the sweat band 18 may be an integral part of the hat 12 or may be sold separately for installation in any desired hat 12.

Figure 3:
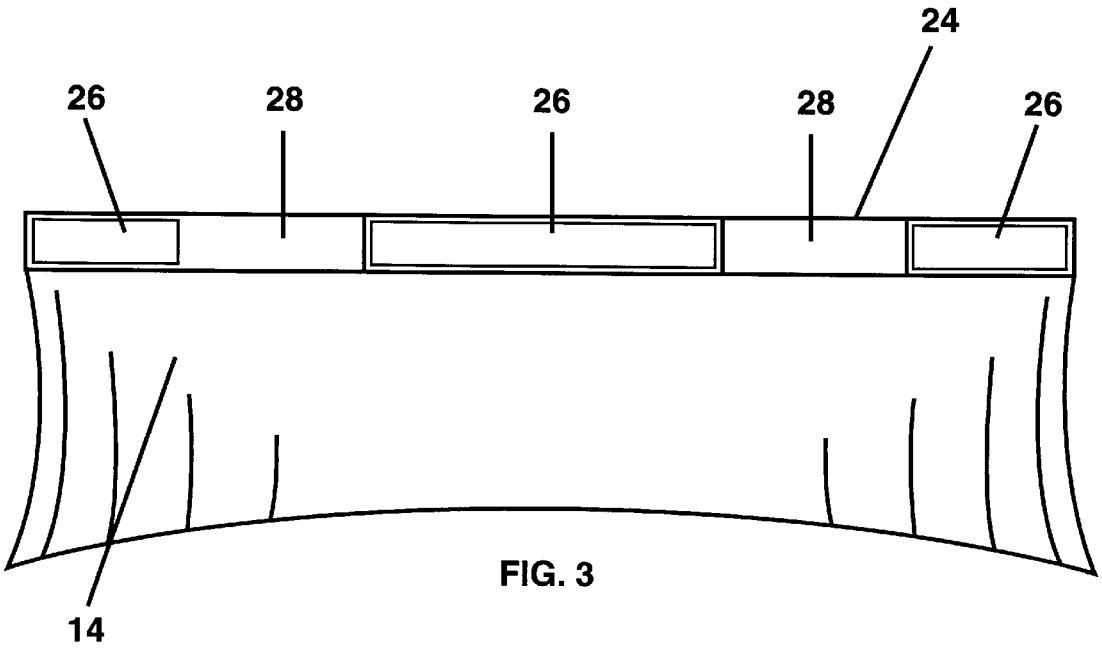
FIG. 3 is an outer view of a hair strip for use with the hat of FIG. 2.
Figure 4:
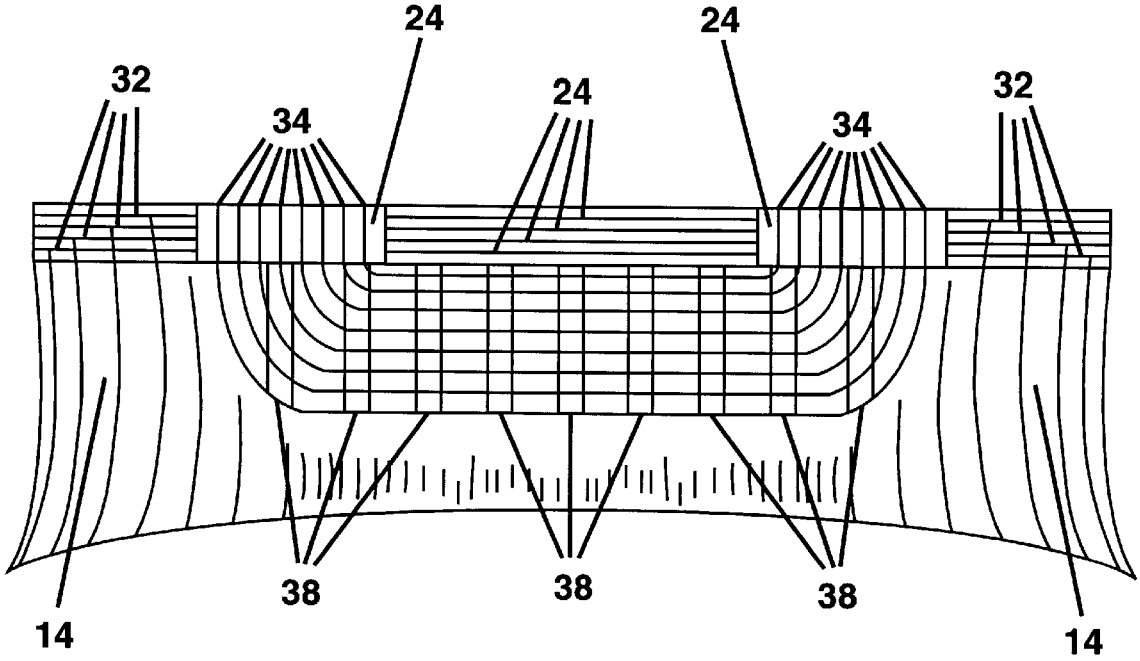
FIG. 4 is an inner view of the hair strip of FIG. 3.

FIGS. 3 and 4 show the temple-to-temple hair strip 14 having an elastic strip 24 with a plurality of patches 26 of the "hook" type of the releasably attachable material known as hook-and-loop material mounted in spaced relation along the outer surface of the hair segments 14 and attached together by connecting elastic segments 28 on the surface of the inner elastic strip 24. On the inner side of the elastic strip 24, as best seen in FIG. 3, a plurality of hair strips 32, 34 and 36 are sewn to the elastic strip 24 in a unique manner. As seen, the hair strips 32 adjacent each end of the elastic strip 24 are sewn substantially parallel to the axis of the elastic strip 24, while the ends of the intermediate hair strips 34 are sewn substantially perpendicular to the axis of the elastic strip 24, allowing the central portions of the intermediate hair strips to drape below the elastic strip 24, which accommodates stretching or flexing of the elastic strip 24. The central hair strips 36 are sewn generally parallel to the axis of the elastic strip 24. Preferably, cloth strips 38 may be provided for additional strength. Obviously, the hair on the hair strips 32, 34 and 36 may be substantially as long as desired.

Figure 5:
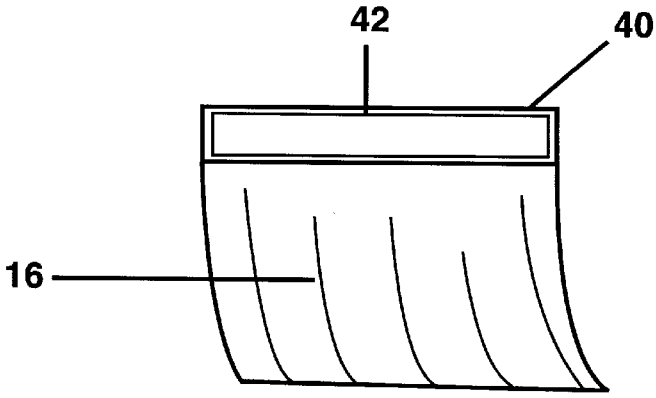
FIG. 5 is an outer view of a hair strip for use in simulating bangs with the hat of FIG. 2.

FIG. 5 shows the hair segment for the bangs 16. This comprises an elastic strip 40 which extends across the brow of the wearer and carries a strip 42 of the "hook" type of hook-and-loop material for releasable attachment to the patch 22 of the "loop" type of hook-and-loop material on the sweatband 18 of the hat 12. The hair strips, not shown, are sewn to the elastic strip 40 substantially parallel to the axis of the strip 40 and, of course, the hair may substantially as long as desired.

In use, the hat 12 may be worn with or without the hair segments 14 and 16. Alternatively, the sweatband 18 may be sewn into substantially any desired hat 12. Because the patches 20 and 22 of the sweatband 18 are formed of the "loop" type of hook-and-loop material, the hat 12 can be worn comfortably and the patches 20 and 22 will not scratch the wearer. When it is desired to attach the temple-to-temple hair segment 14, the wearer removes the hat 12 and simply presses the elastic strip 24 against the sweatband 18 to cause the "hook" type patches 26 of the elastic strip 24 to engage the "loop" type patches 20 on the sweatband 18 and, hence, to attach the hair segment 14 to the hat 12. Thereafter, the wearer can wear the hat 12 in the usual manner, but will give the appearance of having hair. Similarly, by pressing strip 42 of "hook" material on the bangs segment 16 against patch 22 of "loop" material on the sweatband 18, the wearer can attach the bangs segment 16. As noted above, the length of the hair on the temple-to-temple segment 14 or on the bangs segment 16 can be made substantially as long as desired. Thus, the wearer can have several bangs segments 16 of different lengths and, by appropriately substituting longer bangs segments 16, the wearer can simulate hair growth. Obviously, if desired, the hair segments 14 and 16 can be removed, by simply pulling the elastic strip 24 or 40 away from the sweatband 18 to disconnect the releasable attaching means. Thereafter, the hat 12 can be worn without the hair segments 14 or 16 or new hair segments 14 or 16 can be attached.

Obviously, numerous variations and modifications can be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. A hat having releasably attachable hair, said hat comprising:

a sweat band secured to said hat and carrying a plurality of patches of "loop" type hook-and-loop material, and at least one hair segment having a band formed of elastic material carrying a plurality of strips of "hook" type hook-and-loop material with a plurality of hair strips fixedly attached to said band.

2. The hat of claim 1 wherein:

said sweat band is formed of elastic material.

3. The hat of claim 2 wherein:

said hat has a front and a back, and said at least one hair segment is positioned to extend across the brow of a wearer.

4. The hat of claim 1 wherein:

said at least one hair segment is positioned to extend from one temple of a wearer to the opposite temple of the wearer.

5. The hat of claim 1 wherein:

said at least one hair segment comprises a first hair segment which is positioned to extend from one temple of a wearer's head rearward about the back of the wearer's head and to extend forward to the opposite temple of the wearer 's head, and a second hair segment positioned to extend across the brow of a wearer.

6. The hat of claim 1 further comprising:

said sweat band being releasably mountable to said hat.

7. The hat of claim 6 wherein:

said sweat band is formed of elastic material.

8. The hat of claim 6 wherein:

said at least one hair segment is positioned to extend from one temple of a wearer to the opposite temple of the wearer.

9. The hat of claim, 6 wherein:

said hat has a front and a back, and said at least one hair segment is positioned to extend across the brow of a wearer.

10. The hat of claim 6 wherein:

said at least one hair segment comprises a first hair segment which is positioned to extend from one temple of a wearer's head rearward about the back of the wearer's head and to extend forward to the opposite temple of the wearer's head, and a second hair segment positioned to extend across the brow of a wearer.

* * * * *